US006959657B1

(12) United States Patent
Duval

(10) Patent No.: US 6,959,657 B1
(45) Date of Patent: Nov. 1, 2005

(54) OPTICAL STITCH REGULATOR SYSTEM

(76) Inventor: Richard J. Duval, 15-1730 McPherson Court, Pickering, ON (CA) L1W 3E6

( * ) Notice: Subject to any disclaimer, the term of this patent is extended or adjusted under 35 U.S.C. 154(b) by 22 days.

(21) Appl. No.: 10/798,148

(22) Filed: Mar. 10, 2004

(51) Int. Cl.[7] ..... D05B 69/36
(52) U.S. Cl. ..... 112/272; 112/475.02
(58) Field of Search ..... 112/272, 271, 274, 112/275, 277, 470.03, 470.06, 303, 314

(56) References Cited

U.S. PATENT DOCUMENTS 5,215,020 A * 6/1993 Pordzik ..... 112/470.03
5,553,562 A 9/1996 Jacobs, Jr. ..... 114/43
5,908,004 A * 6/1999 Porter et al. ..... 112/470.07
6,501,460 B1 12/2002 Paik et al. ..... 345/163
2005/0016428 A1 * 1/2005 Koerner ..... 112/117

* cited by examiner

*Primary Examiner*—John J. Calvert
*Assistant Examiner*—Brian Kauffman

(57) ABSTRACT

An optical stitch regulator system for efficiently regulating the stitch length and stitch frequency of a sewing machine. The optical stitch regulator system includes at least one optical sensor within or external of the sewing platform of a sewing machine for sensing the motion of the fabric being sewn. The motion data is communicated to a control unit which communicates with the sewing machine for controlling the stitch length and frequency.

14 Claims, 9 Drawing Sheets

OPTICAL STITCH REGULATOR SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to sewing machine stitch regulators and more specifically it relates to an optical stitch regulator system for efficiently regulating the stitch length and stitch frequency of a sewing machine.

2. Description of the Related Art

Conventional stitch regulators for sewing machines have been in use for years. Conventional stitch regulators utilize wheel based encoders that are attached to the frame of the sewing machine.

One of the problems with conventional stitch regulators is that they require multiple wheel based encoders—one for each axis of movement. A further problem with conventional stitch regulators is that they must be utilized upon a straight and smooth surface. A further problem with conventional stitch regulators is that they are dependent upon equipment installed upon the XY carriages to provide the motion feedback of the piece being sewn. Another problem with conventional stitch regulators is that they require external wiring and encoders which can be damaged. Conventional stitch regulators utilize mechanical feedback devices that are dependent upon the XY carriages of the sewing machine and that can be damaged during operation of the sewing machine.

In these respects, the optical stitch regulator system according to the present invention substantially departs from the conventional concepts and designs of the prior art, and in so doing provides an apparatus primarily developed for the purpose of efficiently regulating the stitch length and stitch frequency of a sewing machine.

BRIEF SUMMARY OF THE INVENTION

In view of the foregoing disadvantages inherent in the known types of stitch regulators now present in the prior art, the present invention provides a new optical stitch regulator system construction wherein the same can be utilized for efficiently regulating the stitch length and stitch frequency of a sewing machine.

The general purpose of the present invention, which will be described subsequently in greater detail, is to provide a new optical stitch regulator system that has many of the advantages of the stitch regulators mentioned heretofore and many novel features that result in a new optical stitch regulator system which is not anticipated, rendered obvious, suggested, or even implied by any of the prior art stitch regulators, either alone or in any combination thereof.

To attain this, the present invention generally comprises an optical sensor within or external of the sewing platform of a sewing machine for sensing the motion of the fabric being sewn. The motion data is communicated to a control unit which communicates with the sewing machine for controlling the stitch length and frequency.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an optical stitch regulator system that will overcome the shortcomings of the prior art devices.

A second object is to provide an optical stitch regulator system for efficiently regulating the stitch length and stitch frequency of a sewing machine.

Another object is to provide an optical stitch regulator system that does not require external or mechanical feedback devices.

An additional object is to provide an optical stitch regulator system that can be self-contained within a sewing machine.

A further object is to provide an optical stitch regulator system that may be utilized within new or existing sewing machines.

Another object is to provide an optical stitch regulator system that provides motion feedback of the fabric being sewn independent of the carriage assemblies.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
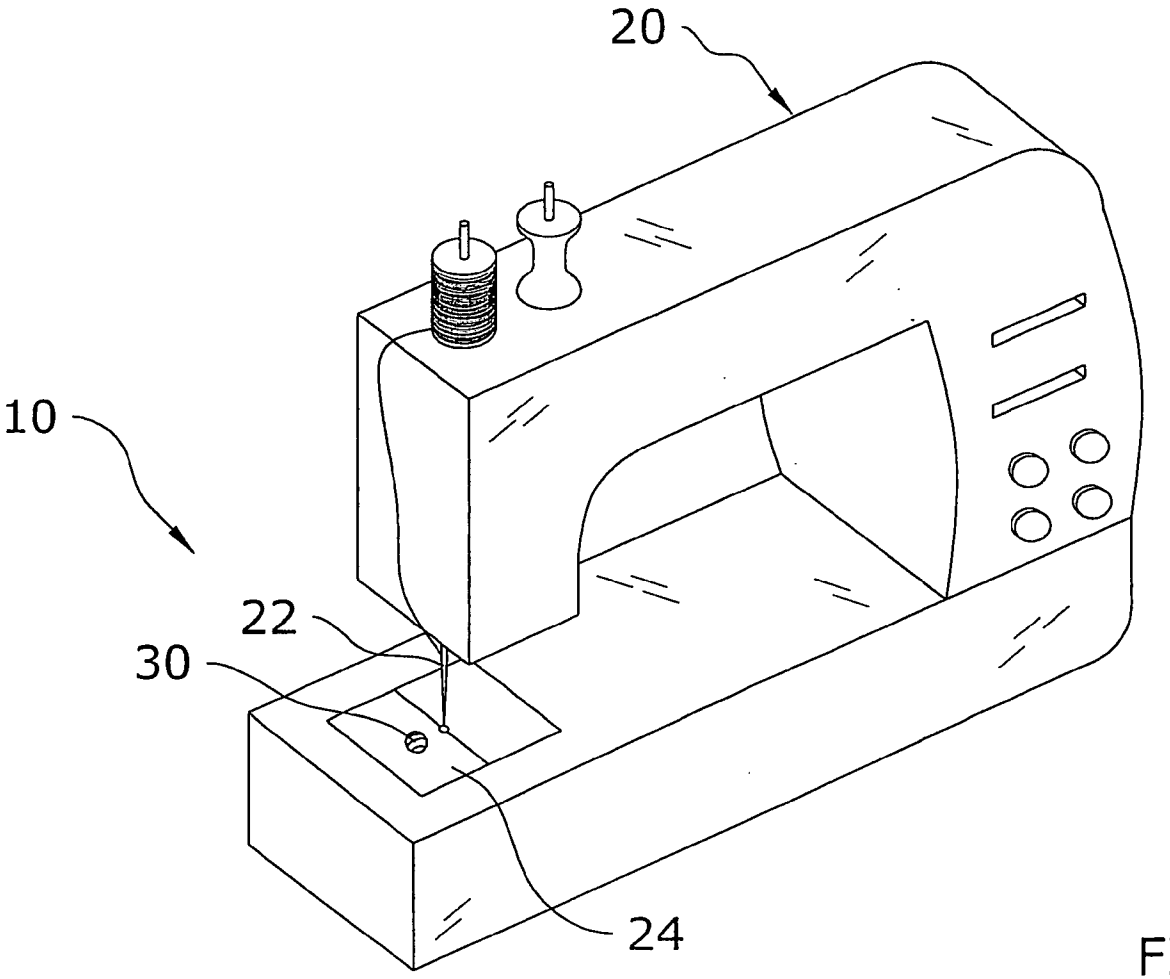
FIG. 1 is an upper perspective view of the present invention.

Turning now descriptively to the drawings, in which similar reference characters denote similar elements throughout the several views, FIGS. 1 through 9 illustrate an optical stitch regulator system 10, which comprises an optical sensor 30 within or external of the sewing platform 24 of a sewing machine 20 for sensing the motion of the fabric 12 being sewn. The motion data is communicated to a control unit 40 which communicates with the sewing machine 20 for controlling the stitch length and frequency.

B. Sewing Machine

The sewing machine 20 may be comprised of any conventional sewing machine 20 (e.g. personal, commercial, industrial). The sewing machine 20 may have various structures and functionality other than shown in FIGS. 1 through 7 of the drawings. For example, the sewing machine 20 may be comprised of a long arm quilting machine wherein the needle 22 is moved relative to the fabric 12 by utilizing carriages to move the needle 22 relative to a fabric 12.

The sewing machine 20 may have its own internal control unit 40 for controlling the stitch length based upon the movement feedback from the optical sensor 30. If the sewing machine 20 does not have an internal control unit 40, then an external control unit 40 is in communication with the sewing machine 20. The control unit 40 controls the motor speed of the sewing machine 20 based upon the movement feedback (e.g. direction, velocity) from the optical sensor 30 so as to maintain a consistent and desired stitching pattern of the fabric 12. For example, if the optical sensor 30 provides movement feedback that the fabric 12 entry velocity has increased, then the sewing machine 20 will increase the motor speed accordingly.

C. Optical Sensor

One or more optical sensors 30 are preferably attached to the sewing machine 20 or a sewing machine carriage for measuring a movement (e.g. direction, velocity) of a piece of fabric 12 being sewn. It can be appreciated that the optical sensors 30 may be attached to a structure external of the sewing machine 20 or the sewing machine carriage. The optical sensor 30 is in communication with the sewing machine 20 regarding the movement of the fabric 12 so that the sewing machine 20 may adjust the motor accordingly to provide a desired stitching pattern.

Figure 2:
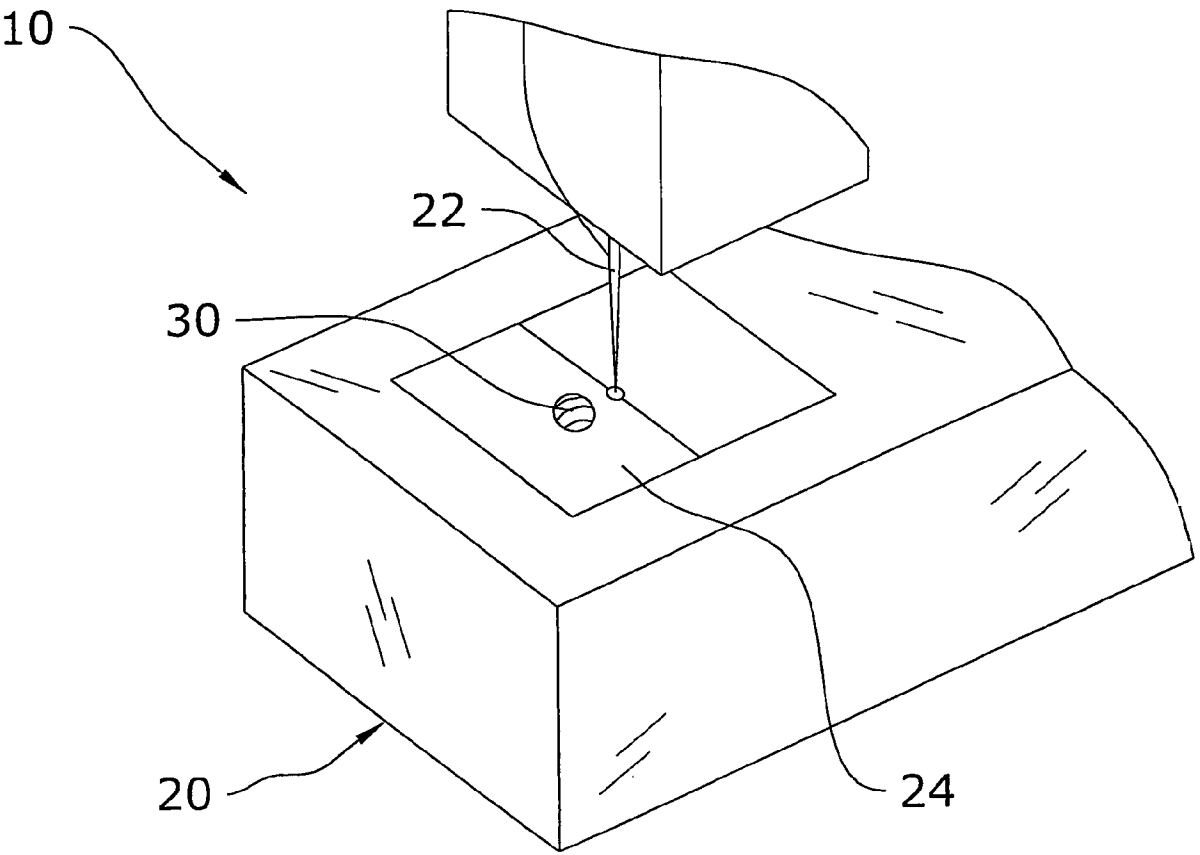
FIG. 2 is a magnified upper perspective view of the present invention.
Figure 3:
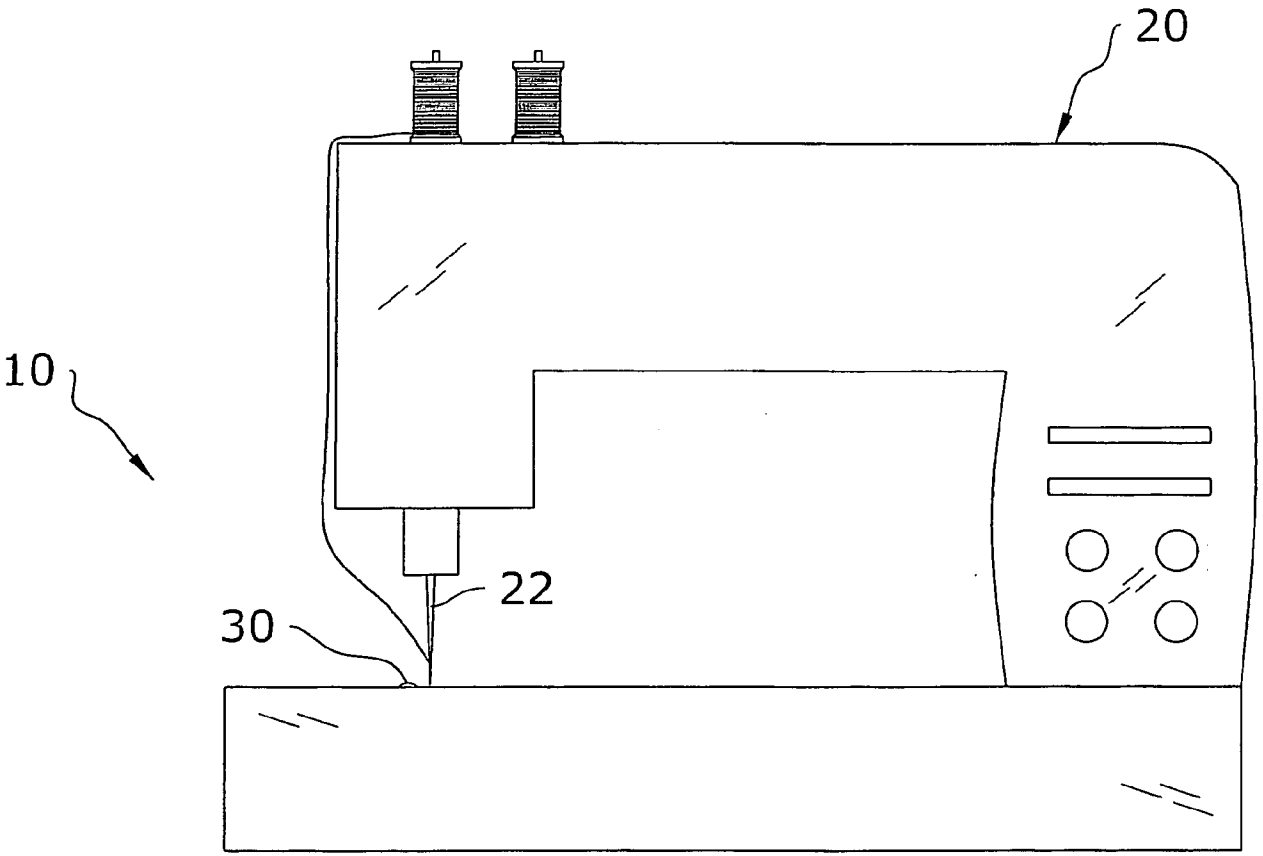
FIG. 3 is a side view of the present invention.
Figure 4:
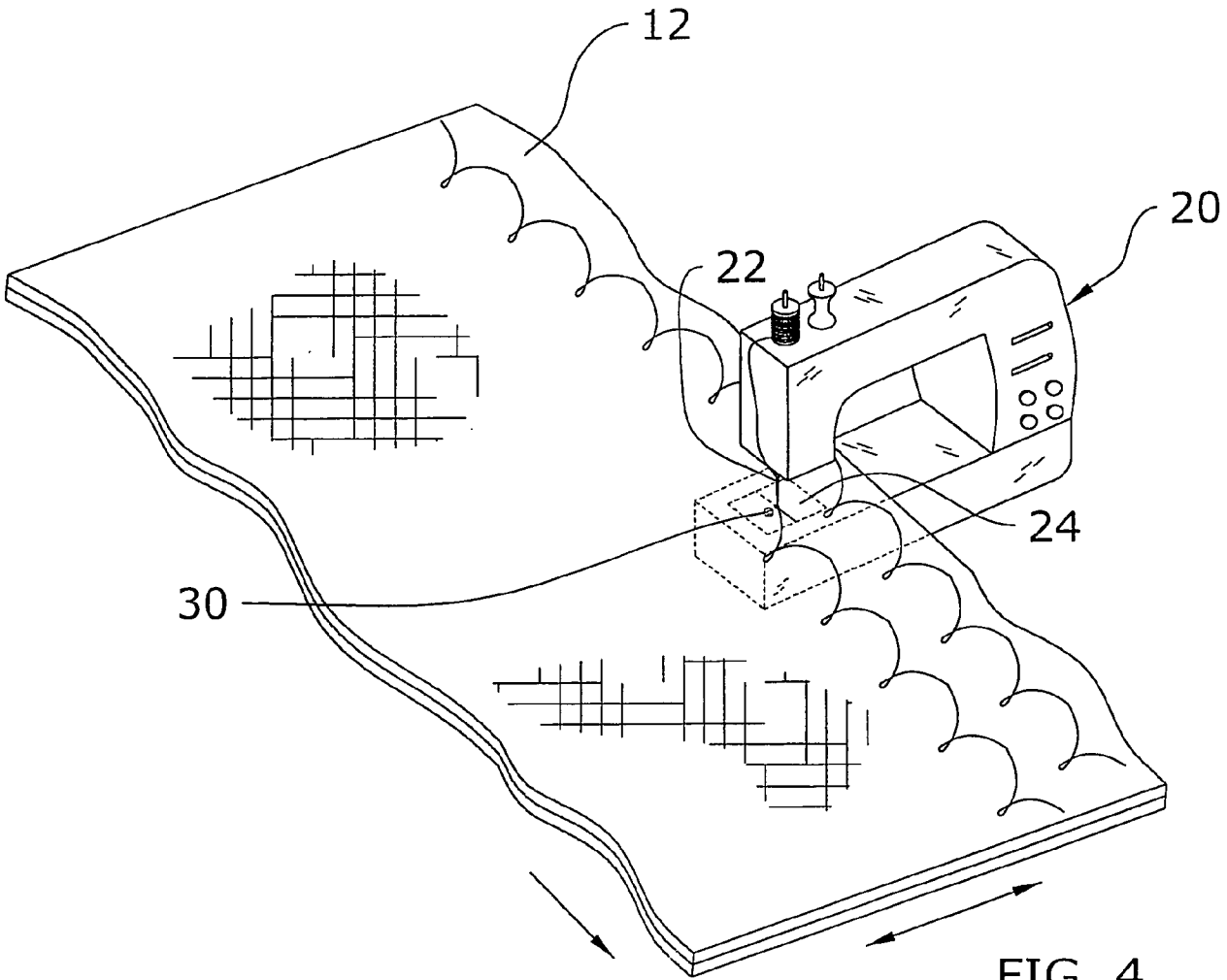
FIG. 4 is an upper perspective view of the present invention sewing a piece of fabric.
Figure 5:
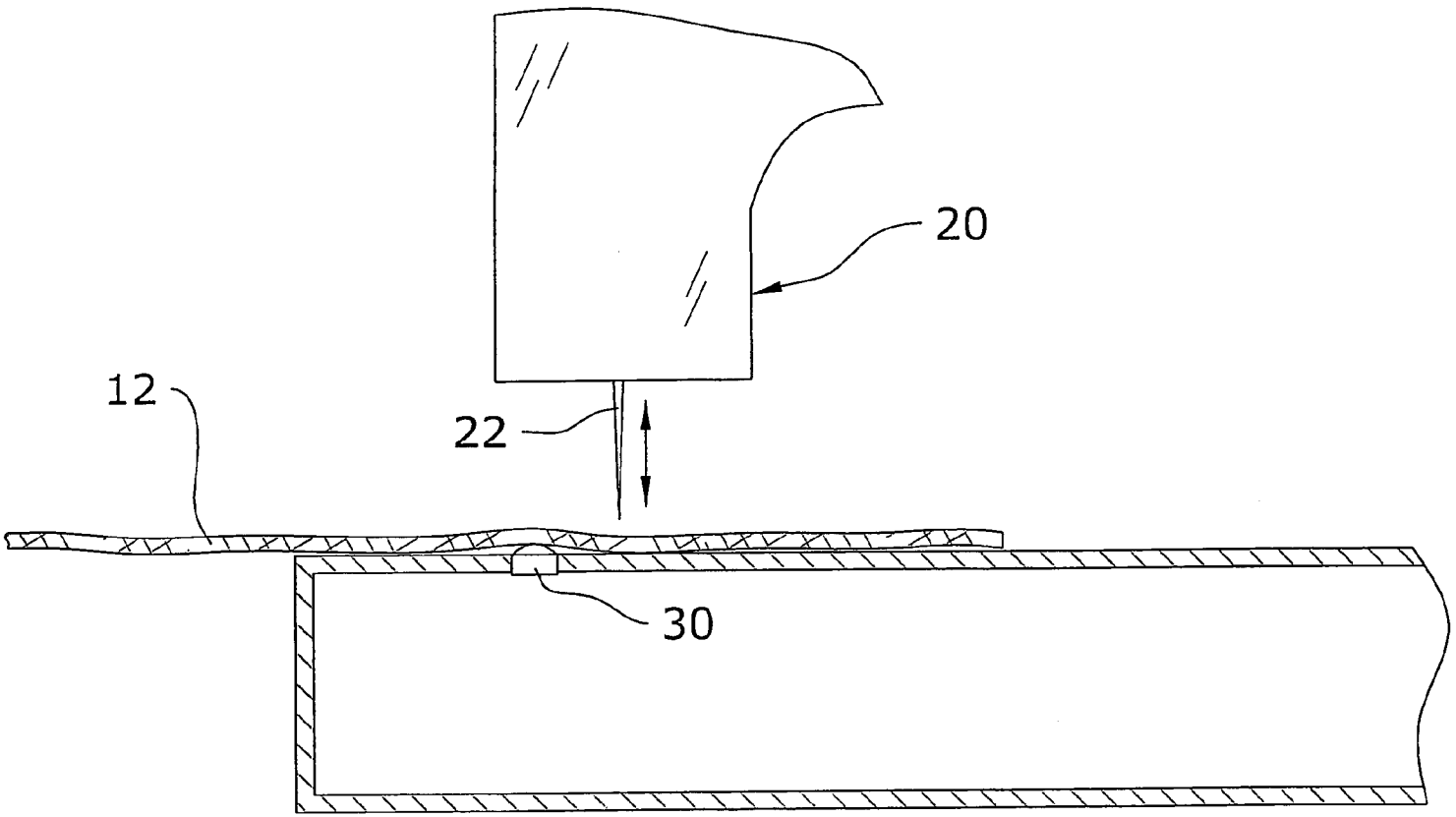
FIG. 5 is a side cutaway view of the present invention sewing a piece of fabric.
Figure 6:
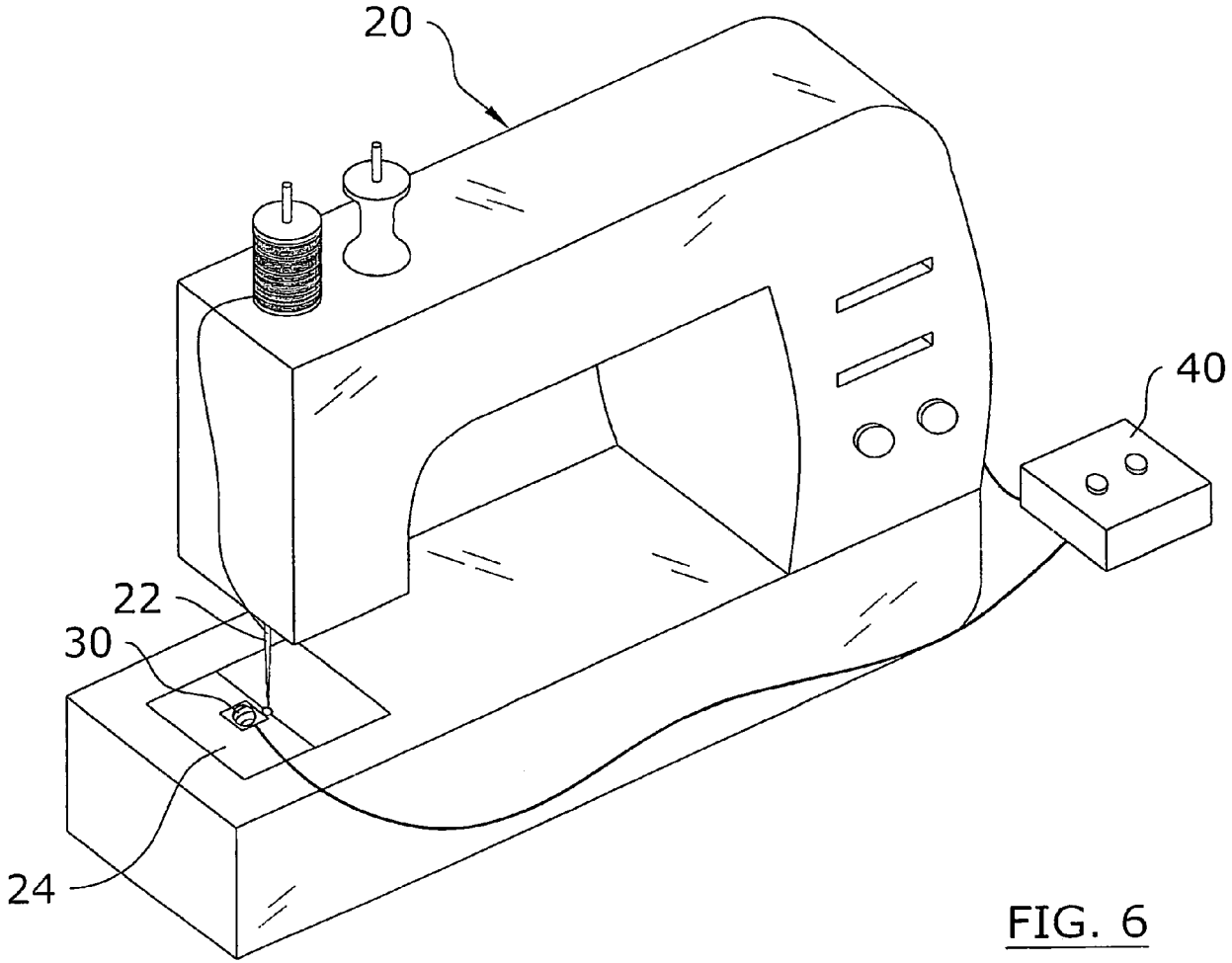
FIG. 6 is an upper perspective view of an alternative embodiment illustrating an exemplary aftermarket attachment.

The optical sensor 30 is preferably positioned within a sewing platform 24 of the sewing machine 20 as shown in FIGS. 1 through 6 of the drawings. The optical sensor 30 is preferably directed substantially upwardly towards the lower surface of the fabric 12 being sewn as best illustrated in FIGS. 3 and 5 of the drawings. The optical sensor 30 preferably extends a finite distance above the sewing platform 24 of the sewing machine 20 to maintain constant contact with the fabric 12 as best illustrated in FIG. 5 of the drawings.

The optical sensor 30 preferably has a curved outer lens as best shown in FIGS. 3 and 5 of the drawings. Alternatively, the optical sensor 30 may also have a flat outer lens as can also be appreciated.

The optical sensor 30 is preferably positioned near the needle 22 of the sewing machine 20 as shown in FIGS. 1, 2 and 5 of the drawings. With the optical sensor 30 positioned in front of the needle 22, the optical sensor 30 is capable of measuring the movement of the fabric 12 entering the needle 22.

The optical sensor 30 is capable of measuring at least one direction of the movement (e.g. an X-axis, Y-axis). The optical sensor 30 is also preferably capable of measuring a velocity of the movement.

The optical sensor 30 is preferably comprised of a combination light source and a light receiver similar in technology to that commonly utilized within an optical computer mouse. The light receiver detects light reflected by a piece of fabric 12 and based upon this information is able to calculate the relative movement of the fabric 12 with respect to the sewing machine 20. The light source may be a light emitting diode or other commonly utilized light source. U.S. Pat. No. 6,501,460 teaches a "light-receiving unit for optical mouse" which is hereby incorporated by reference for teaching an exemplary light source that may be utilized within the present invention.

Figure 9:
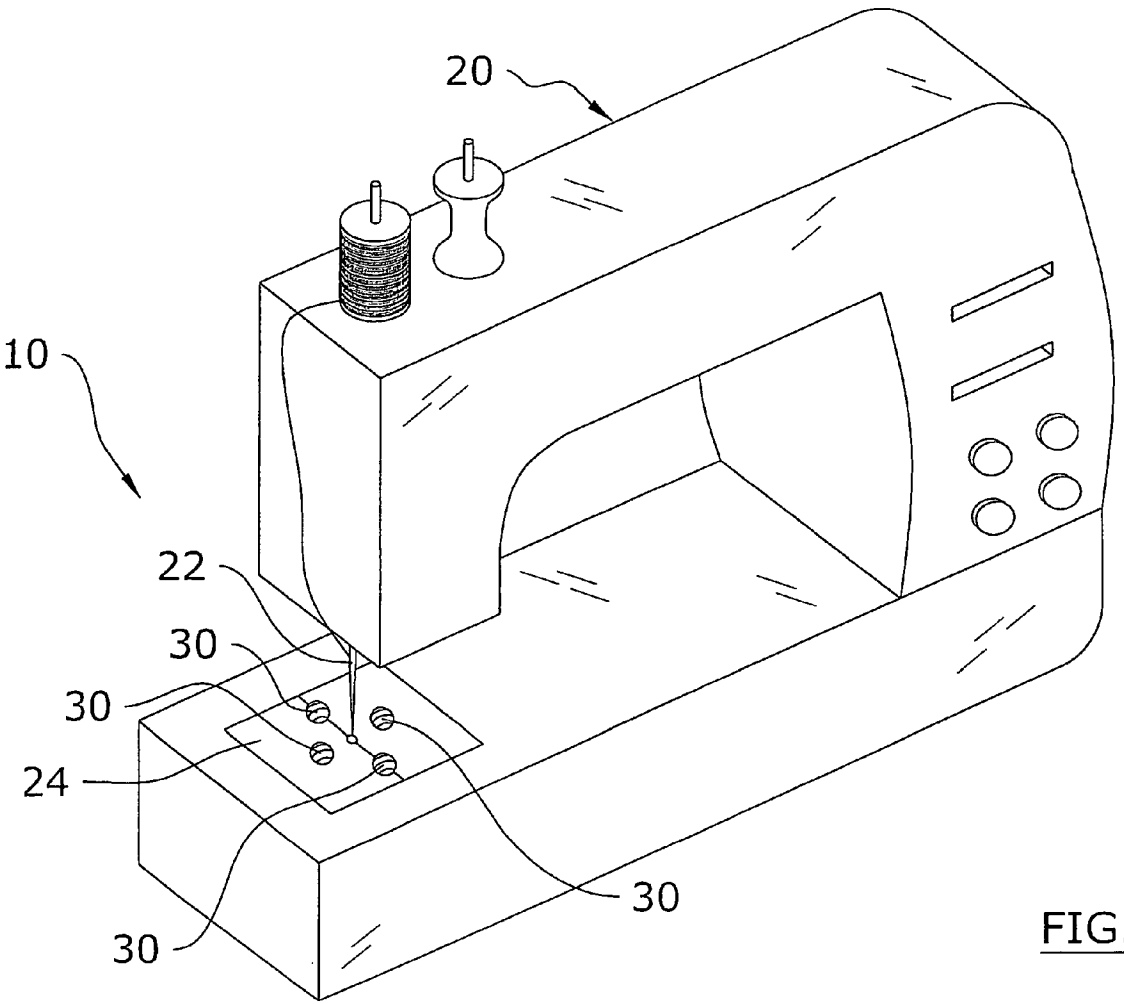
FIG. 9 illustrates a third alternative embodiment wherein the optical sensors are positioned around the needle for determining when a piece of fabric is entering the sewing area of the needle.

FIG. 9 illustrates utilizing more than one optical sensor 30 positioned about various sides of the needle 22 for determining when a piece of fabric 12 enters the sewing area of the needle 22. By positioning the optical sensors 30 about four or more sides of the sewing area, it can be determined if a piece of fabric 12 is entering the sewing area from various angles and approaches. It can be appreciated the plurality of optical sensors 30 shown in FIG. 9 may also extend from above the fabric 12 or from a sewing machine carriage.

D. Control Unit

Figure 7:
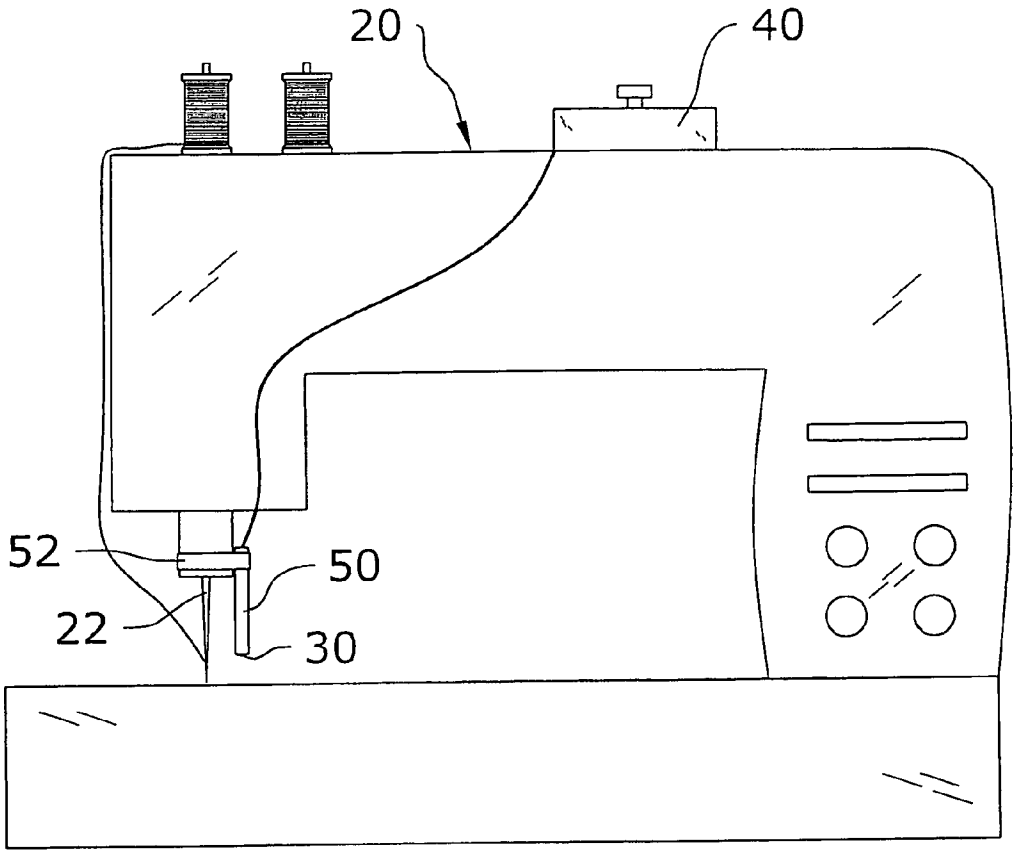
FIG. 7 is a side view of a second alternative embodiment illustrating an exemplary aftermarket attachment.
Figure 8:
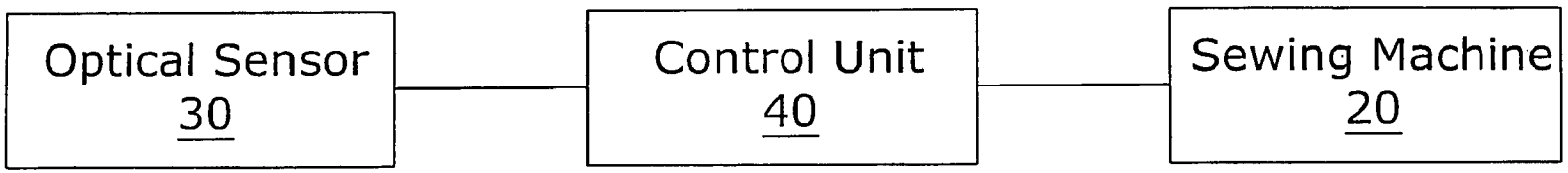
FIG. 8 is a block diagram of the present invention.

The control unit 40 is in communication between the optical sensor 30 and the sewing machine 20 as shown in FIG. 8 of the drawings. The control unit 40 may be internal or external (FIGS. 6 and 7) of the sewing machine 20. The control unit 40 may also be integrated within the optical sensor 30.

The control unit 40 is preferably comprised of a motion interpretation module that transmits movement information to the sewing machine 20 and thereby controls the speed of the sewing machine 20 based upon the movement of the fabric 12. The motor control module within the sewing machine 20 receives the movement data from the control unit 40 (or directly from the optical sensor 30) and then controls the motor of the sewing machine 20 accordingly. The control unit 40 may include various other control features such as control knobs for controlling the stitching pattern and the like.

E. Support Member

Alternatively, the optical sensor 30 is directed downwardly as shown in FIG. 7 of the drawings. A support member 50 is attached to a portion of the sewing machine 20 and supports the optical sensor 30 in a downward manner. It is preferable that the optical sensor 30 be positioned relatively close to the upper surface of the fabric 12 being sewn. An attachment member 52 (e.g. band) or other attachment means attaches the support member 50 to the upper portion of the sewing machine 20 as further shown in FIG. 7 of the drawings.

F. Operation of Invention

In use, the user positions the fabric 12 to be sewn upon the sewing platform 24 of the sewing machine 20. The sewing machine 20 is preferably preset to a desired stitching pattern. The user then causes the fabric 12 to move relative to the needle 22 of the sewing machine 20 and the sewing machine 20 begins to sew the fabric 12 by causing the needle 22 to reciprocate in a desired frequency.

The optical sensor 30 senses the movement of the fabric 12 with respect to the needle 22 and then provides this movement data to the control unit 40. The control unit 40 then communicates with the sewing machine 20 and the motor of the sewing machine 20 is adjusted accordingly. For example, if the fabric 12 speed is increased then the sewing machine 20 will increase the motor speed to increase the frequency of the needle 22 movement. If the fabric 12 speed is decreased then the sewing machine 20 will decrease the motor speed to decrease the frequency of the needle 22 movement. This allows the sewing machine 20 to provide a consistent stitching pattern regardless of the movement of the fabric 12.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. An optical stitch regulator system, comprising:

a sewing machine; and at least one optical sensor attached to said sewing machine for measuring a movement of a piece of fabric relative to a needle of said sewing machine, wherein said movement is comprised of a direction and a velocity of the piece of fabric and, wherein said optical sensor is in communication with said sewing machine regarding said movement, wherein said optical sensor is positioned within a sewing platform of said sewing machine, and wherein said optical sensor extends above an upper surface of said sewing platform.

2. The optical stitch regulator system of claim 1, wherein said optical sensor is positioned within a sewing platform of said sewing machine.

3. The optical stitch regulator system of claim 2, wherein said optical sensor is directed substantially upwardly.

4. The optical stitch regulator system of claim 1, wherein said optical sensor is positioned near said needle of said sewing machine.

5. The optical stitch regulator system of claim 1, wherein said optical sensor is positioned in front of said needle of said sewing machine.

6. The optical stitch regulator system of claim 1, wherein said sewing machine controls the sewing operation based upon said movement for producing consistent stitches.

7. The optical stitch regulator system of claim 1, including a control unit in communication between said optical sensor and said sewing machine, wherein said control unit is comprised of a motion interpretation module that transmits movement information to said sewing machine.

8. The optical stitch regulator system of claim 1, wherein said optical sensor is directed downwardly.

9. The optical stitch regulator system of claim 8, including a support member attached to said sewing machine and supporting said optical sensor.

10. The optical stitch regulator system of claim 9, including an attachment member that attaches said support member to said upper portion of said sewing machine.

11. The optical stitch regulator system of claim 1, wherein said optical sensor is comprised of a light source and a light receiver, wherein said light receiver detects light reflected by a piece of fabric.

12. The optical stitch regulator system of claim 11, wherein said light source is a light emitting diode.

13. A process of operating an optical stitch regulator for a sewing machine, said process comprising:

sensing a movement of fabric relative to a needle of a sewing machine with at least one optical sensor, wherein said movement is comprised of a direction and a velocity of said movement, wherein said optical sensor is positioned within a sewing platform of said sewing machine, and wherein said optical sensor extends above an upper surface of said sewing platform;

generating a movement data representing said movement; and adjusting a motor speed within said sewing machine based upon said movement data.

14. An optical stitch regulator system, comprising:

a sewing machine carriage; and at least one optical sensor attached to said sewing machine carriage for measuring a movement of a piece of fabric relative to a needle of a sewing machine, wherein said movement is comprised of a direction and a velocity of the piece of fabric and, wherein said optical sensor is capable of communicating with a sewing machine regarding said movement, wherein said optical sensor is positioned within a sewing platform of said sewing machine, and wherein said optical sensor extends above an upper surface of said sewing platform.

* * * * *